US006695051B2

(12) United States Patent
Smith et al.

(10) Patent No.: US 6,695,051 B2
(45) Date of Patent: Feb. 24, 2004

(54) EXPANDABLE RETAINING SHOE

(75) Inventors: Donald R. Smith, Wilson, OK (US); Donald W. Winslow, Duncan, OK (US); Lloyd A. Crockford, Houston, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/165,999

(22) Filed: Jun. 10, 2002

(65) Prior Publication Data

US 2003/0226659 A1 Dec. 11, 2003

(51) Int. Cl.[7] ..... E21B 23/06
(52) U.S. Cl. ..... 166/134; 166/138; 166/192
(58) Field of Search ..... 164/118, 134, 164/386, 192, 387, 138

(56) References Cited

U.S. PATENT DOCUMENTS

| | | | | |
|---|---|---|---|---|
| 2,368,928 A | | 2/1945 | King | 166/10 |
| 4,151,875 A | | 5/1979 | Sullaway | 166/126 |
| 5,224,540 A | | 7/1993 | Streich et al. | 166/118 |
| 5,271,468 A | | 12/1993 | Streich et al. | 166/387 |
| 5,390,737 A | | 2/1995 | Jacobi et al. | 166/184 |
| 5,540,279 A | | 7/1996 | Branch et al. | 166/118 |
| 5,701,959 A | | 12/1997 | Hushbeck et al. | 166/387 |
| 6,102,117 A | | 8/2000 | Swor et al. | 166/138 |
| 6,167,963 B1 | | 1/2001 | McMahan et al. | 166/179 |
| 2002/0043368 A1 | * | 4/2002 | Bell et al. | 166/118 |
| 2003/0000710 A1 | * | 1/2003 | Turley et al. | 166/386 |

FOREIGN PATENT DOCUMENTS

| | | | |
|---|---|---|---|
| EP | 1 197 632 A2 | 4/2002 | E21B/33/12 |

OTHER PUBLICATIONS

Halliburton Services Sales & Service Catalog No. 43, pp. 2561–2562 and 2556–2557 (1985).

* cited by examiner

*Primary Examiner*—David Bagnell
*Assistant Examiner*—Jennifer R. Dougherty
(74) *Attorney, Agent, or Firm*—John W. Wustenberg; Anthony L. Rahhal

(57) ABSTRACT

An improved downhole tool apparatus for limiting the extrusion of a packer element. The apparatus includes a packer mandrel having a packer element assembly disposed in a wellbore. Packer retaining shoes are disposed about the packer mandrel at the ends of the packer element assembly. The packer retaining shoes have an inner retainer and an outer retainer. The inner retainer has a plurality of segments having gaps therebetween that expand in width when the retaining shoe is moved from an initial position in which it is disposed about the packer mandrel to an expanded position wherein it engages the wellbore to limit the extrusion of the packer element assembly. The outer retainer is likewise made up of a plurality of segments having gaps therebetween that will expand. The inner retainer segments cover the gaps that exist between the outer retainer segments and the outer retainer segments cover the gaps that exist between the inner retainer segments so that extrusion is limited. The retaining shoes provide enhanced high temperature and higher pressure performance in that extrusion in wells having high temperature and high pressure is severely limited if not completely prevented.

25 Claims, 5 Drawing Sheets

EXPANDABLE RETAINING SHOE

FIELD OF THE INVENTION

This invention relates generally to downhole tools for use in wellbores and methods of drilling such apparatus out of wellbores, and more specifically, to such tools having drillable components made at least partially of composite or non-metallic materials, such as engineering grade plastics, composites, and resins. This invention relates particularly to improvements in preventing undesired extrusion of packer seal elements between segmented non-metallic packer element shoes, alternatively referred to as back-up shoes, back-up rings, retaining shoes, packer shoes, or retaining rings, used to provide support to expandable packer elements used in drillable, essentially nonmetallic packer and bridge plug type tools. This invention is especially suitable for use with such segmented non-metallic packer element retaining shoes used in extreme temperature and differential pressure environments which tend to make expandable packer element seals more prone to extrusion, related damage, and possibly failure.

BACKGROUND OF THE INVENTION

In the drilling or reworking of oil wells, a great variety of downhole tools are used. For example, but not by way of limitation, it is often desirable to seal tubing or other pipe in the casing of the well, such as when it is desired to pump cement or other slurry down the tubing and force the cement or slurry around the annulus of the tubing or out into a formation. It then becomes necessary to seal the tubing with respect to the well casing and to prevent the fluid pressure of the slurry from lifting the tubing out of the well or for otherwise isolating specific zones in a well. Downhole tools referred to as packers and bridge plugs are designed for these general purposes and are well known in the art of producing oil and gas.

When it is desired to remove many of these downhole tools from a wellbore, it is frequently simpler and less expensive to mill or drill them out rather than to implement a complex retrieving operation. In milling, a milling cutter is used to grind the packer or plug, for example, or at least the outer components thereof, out of the wellbore. Milling is a relatively slow process, but milling with conventional tubular strings can be used to remove packers or bridge plugs having relative hard components such as erosion-resistant hard steel. One such packer is disclosed in U.S. Pat. No. 4,151,875 to Sullaway, assigned to the assignee of the present invention and sold under the trademark EZ Disposal® packer.

In drilling, a drill bit is used to cut and grind up the components of the downhole tool to remove it from the wellbore. This is a much faster operation than milling, but requires the tool to be made out of materials which can be accommodated by the drill bit.

Typically, soft and medium hardness cast iron are used on the pressure bearing components, along with some brass and aluminum items. Packers of this type include the Halliburton EZ Drill® and EZ Drill® SV squeeze packers.

The EZ Drill® SV squeeze packer, for example, includes a lock ring housing, upper slip wedge, lower slip wedge, and lower slip support made of soft cast iron. These components are mounted on a mandrel made of medium hardness cast iron. The EZ Drill® bridge plug is also similar, except that it does not provide for fluid flow therethrough.

All of the above-mentioned packers are disclosed in Halliburton Services—Sales and Service Catalog No. 43, pages 2561–2562, and the bridge plug is disclosed in the same catalog on pages 2556–2557.

The EZ Drill® packer and bridge plug and the EZ Drill® SV packer are designed for fast removal from the wellbore by either rotary or cable tool drilling methods. Many of the components in these drillable packing devices are locked together to prevent their spinning while being drilled, and the harder slips are grooved so that they will be broken up in small pieces. Typically, standard "tri-cone" rotary drill bits are used which are rotated at speeds of about 75 to about 120 rpm. A load of about 5,000 to about 7,000 pounds of weight is applied to the bit for initial drilling and increased as necessary to drill out the remainder of the packer or bridge plug, depending upon its size. Drill collars may be used as required for weight and bit stabilization.

Such drillable devices have worked well and provide improved operating performance at relatively high temperatures and pressures. The packers and bridge plugs mentioned above are designed to withstand pressures of about 10,000 psi (700 kg/cm$^2$) and temperatures of about 425° F. (220° C.) after being set in the wellbore. Such pressures and temperatures require using the cast iron components previously discussed.

However, drilling out cast iron components requires certain techniques. Ideally, the operator employs variations in rotary speed and bit weight to help break up the metal parts and re-establish bit penetration should bit penetration cease while drilling. A phenomenon known as "bit tracking" can occur, wherein the drill bit stays on one path and no longer cuts into the downhole tool. When this happens, it is necessary to pick up the bit above the drilling surface and rapidly recontact the bit with the packer or bridge plug and apply weight while continuing rotation. This aids in breaking up the established bit pattern and helps to re-establish bit penetration. If this procedure is used, there are rarely problems. However, operators may not apply these techniques or even recognize when bit tracking has occurred. The result is that drilling times are greatly increased because the bit merely wears against the surface of the downhole tool rather than cutting into it to break it up.

In order to overcome the above long-standing problems, the assignee of the present invention introduced to the industry a line of drillable packers and bridge plugs currently marketed by the assignee under the trademark FAS DRILL®. The FAS DRILL® line of tools has a majority of the components made of non-metallic engineering grade plastics to greatly improve the drillability of such downhole tools. The FAS DRILL® line of tools has been very successful and a number of U.S. patents have been issued to the assignee of the present invention, including U.S. Pat. No. 5,271,468 to Streich et al., U.S. Pat. No. 5,224,540 to Streich et al., and U.S. Pat. No. 5,390,737 to Jacobi et al, all of which are incorporated herein by reference.

Notwithstanding the success of the FAS DRILL® line of drillable downhole packers and bridge plugs, the assignee of the present invention discovered that certain metallic components still used within the FAS DRILL® line of packers and bridge plugs at the time of issuance of the above patents were preventing even quicker drill-out times under certain conditions or when using certain equipment. Exemplary situations include milling with conventional jointed tubulars and in conditions in which normal bit weight or bit speed could not be obtained. Other exemplary situations include drilling or milling with non-conventional drilling techniques such as milling or drilling with relatively flexible coiled tubing.

When milling or drilling with coiled tubing, which does not provide a significant amount of weight on the tool being used, even components made of relatively soft steel, or other metals considered to be low strength, create problems and increase the amount of time required to mill out or drill out a downhole tool, including such tools as the assignee's FAS DRILL® line of drillable non-metallic downhole tools.

Furthermore, packer shoes and optional back-up rings made of a metallic material are employed not so much as a first choice but due to the metallic shoes and back-up rings being able to withstand the temperatures and pressures typically encountered by a downhole tool deployed in a borehole.

To address the preceding shortcomings, the assignee hereof filed a U.S. patent application on May 5, 1995, Ser. No. 08/442,448, which issued on May 30, 1996, as U.S. Pat. No. 5,540,279 (the '279 patent), describing and claiming an improved downhole tool apparatus preferably utilizing essentially all non-metallic materials such as engineering grade plastics, resins, or composites. The '279 patent describes a wellbore packing-type apparatus making use of essentially only non-metallic components in the downhole tool apparatus for increasing the efficiency of alternative drilling and milling techniques in addition to conventional drilling and milling techniques and further provides a segmented non-metallic back-up ring in lieu of a conventional metallic packer shoe having a metallic supporting ring. The tool discussed in the '279 patent preferably employs the general geometric configuration of previously known drillable non-metallic packers and bridge plugs such as those disclosed in the aforementioned U.S. Pat. Nos. 5,271,468, 5,224,540, and 5,390,737, while replacing essentially all of the few remaining metal components of the tools disclosed in the aforementioned patents with non-metallic materials which can still withstand the pressures and temperatures found in many wellbore applications. In the '279 patent, the apparatus also includes specific design changes to accommodate the advantages of using essentially only plastic and composite materials and to allow for the reduced strengths thereof compared to metal components. Additionally, the '279 embodiment comprises a center mandrel and slip means disposed on the mandrel for grippingly engaging the wellbore when in a set position, a packing means disposed on the mandrel for sealingly engaging the wellbore when in a set position, the slip means comprising a slip wedge positioned around the center mandrel, a plurality of slip segments disposed in an initial position around the mandrel and adjacent to the slip wedge, and retaining means for holding the slip segments in an initial position. The slip segments expand radially outwardly upon being set so as to grippingly engage the wellbore. Hardened inserts can be molded, or otherwise installed into the slips, and can be made of, by way of example, a ceramic material.

In the preferred embodiment of the '279 patent, the slip means includes a slip wedge installed on the mandrel and the slip segments, whether retained by a retaining band or whether retained by an integral ring portion, have co-acting planar, or flat portions, which provided a superior sliding bearing surface especially when the slip means are made of a non-metallic material such as engineering-grade plastics, resins, phenolics, or composites.

Furthermore, in the '279 patent, prior art packer element shoes and back-up rings, such as those referred to as elements 37, 38, 44, and 45 in the U.S. Pat. No. 5,271,468 patent, were replaced by a non-metallic packer shoe having a multitude of co-acting non-metallic segments and at least one retaining band, and preferably two non-metallic bands, for holding the shoe segments in place after initial assembly and during the running of the tool into the wellbore and prior to the setting of the associated packer element within the wellbore.

Notwithstanding the success of the invention described in the '279 patent, in that tools made in accordance thereto are able to withstand the stresses induced by relatively high differential pressures and high temperatures found within wellbore environments, the assignee of the present invention discovered that when using packer-type tools in high temperature environments, such as temperatures, for example, exceeding 250° F., there was a possibility for the non-metallic segmented packer element back-up shoes, also referred to as back-up rings, to allow the packer element to extrude through gaps that are designed to form between the back-up ring segments upon the segments being forced radially outward toward the wellbore surface when the packer element was activated. Upon certain conditions, the larger O.D. packer elements, and smaller O.D. packer elements upon being subjected to elevated pressures and temperatures, were subject to being extruded through these gaps thereby possibly damaging the packer element and jeopardizing the integrity of the seal between the wellbore and the packer elements.

To address the issue of unwanted extrusion, the assignee of the present invention filed a patent application on Mar. 29, 1996, which issued as U.S. Pat. No. 5,701,959 (the '959 patent) on Dec. 30, 1997, which is incorporated herein by reference. The '959 invention, like the '279 invention, includes a non-metallic shoe having a multitude of co-acting non-metallic segments and at least one retaining band, and preferably two retaining bands for holding the shoe segments in place after initial assembly and during the running of the tool into the wellbore and prior to the sealing of the associated packer element within the wellbore. The invention described in the '959 patent provides a disk to act as a gap-spanning, structural member. The shoe segments described in the '959 patent include disk pockets on an inner surface thereof. Each disk pocket is centered over the gap that it is to bridge, so that a pocket for a single disk comprises two half pockets located on adjacent shoe segments. The disk in the '959 patent was designed to span the gap between adjacent segments that increases in size when the packer element is set in the wellbore.

Although the inventions described in the '959 and '279 patents work well for their intended purpose, there is a further need for an easily drillable downhole packer-type tool apparatus preferably being made at least partly, if not essentially entirely, of nonmetallic, such as, but not limited to, composite components, and which include expandable packer elements to be partially retained by non-metallic segmented packer element shoes, or retaining rings that prohibit, or at least significantly reduce, unwanted extrusion of packer elements between gaps of such segmented shoes or segmented rings. While the invention described in the '279 patent works well in many cases, there is still a need for a retaining shoe that will prohibit, or at least limit, unwanted extrusion of the packer element in high pressure, high temperature wells of up to 350° F. and 10,000 psi.

SUMMARY OF THE INVENTION

The present invention provides a downhole packer apparatus for preventing the extrusion of a packer element assembly installed about a packer mandrel. The packer mandrel has a longitudinal central axis and a slip means disposed on the packer mandrel for grippingly engaging a wellbore, and preferably a casing in the wellbore, when the packer apparatus is moved from an unset to a set position. A packer element assembly is disposed about the packer mandrel and includes at least one packer element to be axially retained about the packer mandrel. The invention also includes at least one packer element assembly retaining shoe disposed about the packer mandrel for axially retaining the packer element assembly and for preventing extrusion of the packer element assembly when the packer apparatus is set into position. The retaining shoe includes an inner shoe and an outer shoe. The inner shoe is comprised of a plurality of inner shoe segments. Adjacent ones of the inner shoe segments have gaps therebetween which may be zero when initially installed but which will expand from the initial installed position, wherein the gaps may be zero or slightly greater than zero, to a greater width when the packer apparatus is set into position, thus moving the inner shoe to an expanded position. The inner shoe may comprise a generally cylindrical body portion which may engage the packer mandrel when the packer apparatus is in its unset position, and a fin sloping radially outwardly from the body portion. Each inner shoe segment thus comprises a body portion having a fin portion sloping radially outwardly therefrom.

The outer shoe of the retaining shoe is comprised of a plurality of outer shoe segments. Adjacent ones of the outer shoe segments will spread apart so that the width of a gap therebetween will expand as the retaining shoe moves from its initial position, wherein the outer shoe segments and the wellbore define a space therebetween, to an expanded position, wherein the retaining shoe engages the wellbore. The expanded position of the retaining shoe corresponds to the set position of the packer apparatus in the wellbore. In the expanded position of the retaining shoe, the retaining shoe engages the wellbore and prevents, or at least limits, extrusion of the packer element assembly. Wellbore is understood to mean either a wellbore in an openhole completion or a casing disposed in a wellbore in a cased completion, unless the context indicates otherwise.

Additional objects and advantages of the invention will become apparent as the following detailed description of the preferred embodiment is read in conjunction with the drawings which illustrate the preferred embodiment of the present invention.

DESCRIPTION OF PREFERRED EMBODIMENTS

Figure 1:
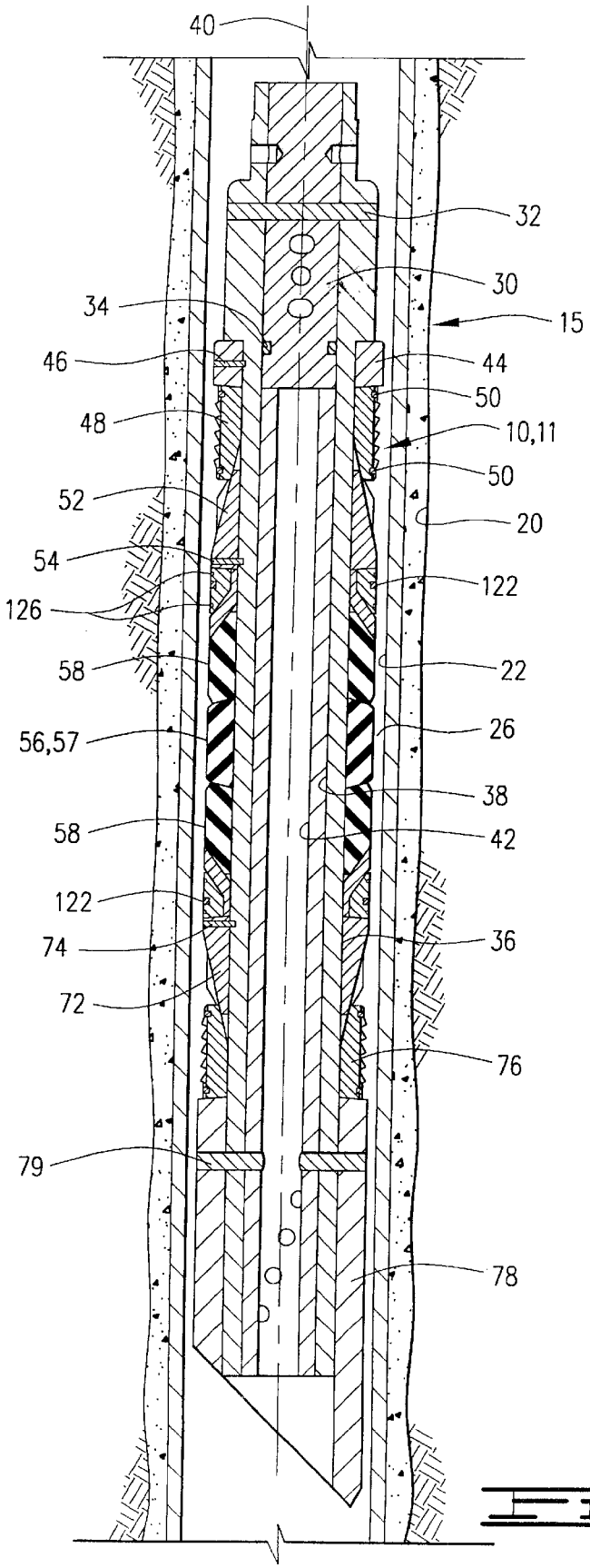
FIG. 1 is a cross-sectional side view of a packer apparatus having upper and lower retaining shoes embodying the present invention.
Figure 2:
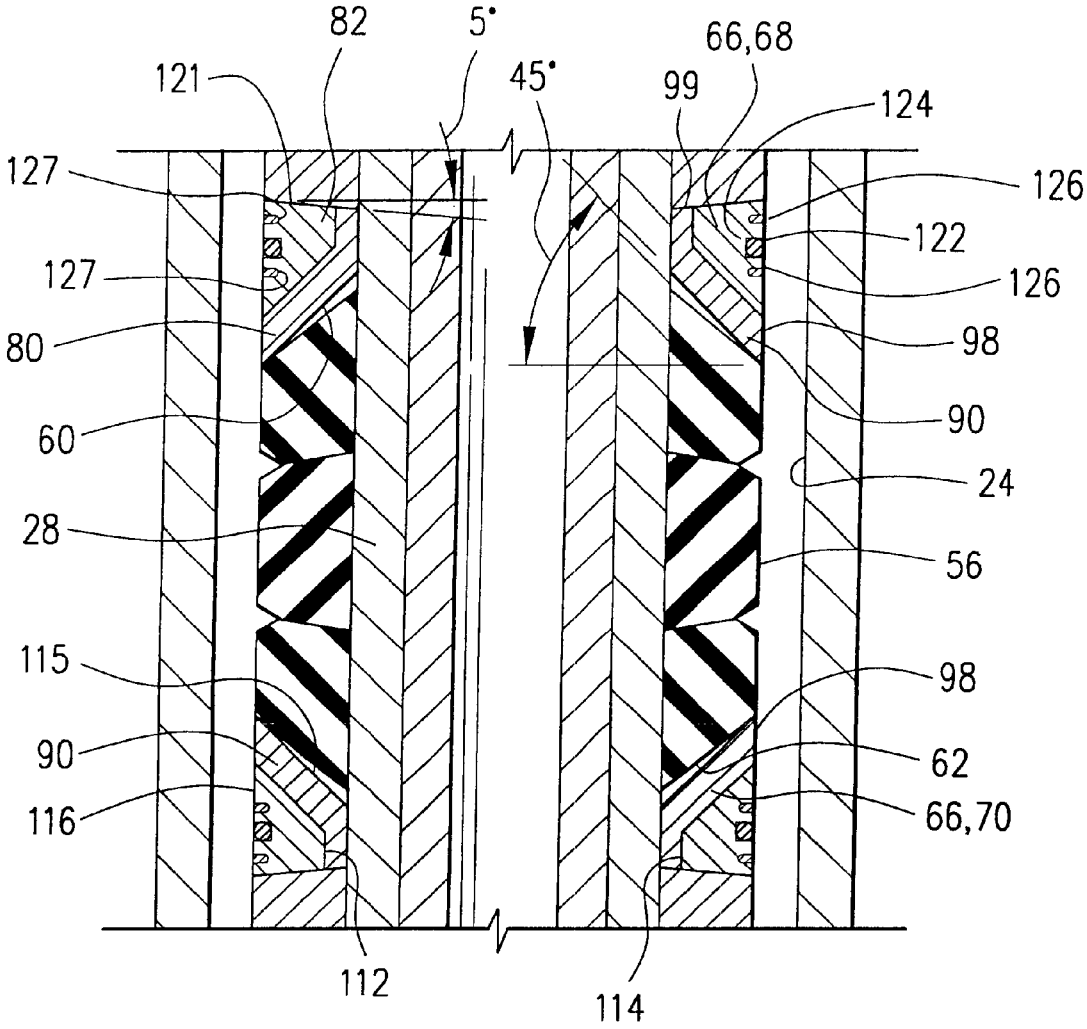
FIG. 2 is a cross-sectional side view of a packer element assembly and retaining shoes of the present invention.

Referring now to FIGS. 1 and 2, downhole tool, or downhole apparatus 10 is shown in an unset position 11 in a well 15 having a wellbore 20. The wellbore 20 can be either a cased completion with a casing 22 cemented therein as shown in FIG. 1 or an openhole completion. Downhole apparatus 10 is shown in set position 13 in FIG. 3. Casing 22 has an inner surface 24. An annulus 26 is defined by casing 22 and downhole tool 10. Downhole tool 10 has a packer mandrel 28, and may be referred to as a bridge plug due to the downhole tool 10 having a plug 30 being pinned within packer mandrel 28 by radially oriented pins 32. Plug 30 has a seal means 34 located between plug 30 and the internal diameter of packer mandrel 28 to prevent fluid flow therebetween. The overall downhole tool 10 structure, however, is adaptable to tools referred to as packers, which typically have at least one means for allowing fluid communication through the tool. Packers may therefore allow for the controlling of fluid passage through the tool by way of one or more valve mechanisms which may be integral to the packer body or which may be externally attached to the packer body. Such valve mechanisms are not shown in the drawings of the present document. Packer tools may be deployed in wellbores having casings or other such annular structure or geometry in which the tool may be set.

Packer mandrel 28 has an outer surface 36, an inner surface 38, and a longitudinal central axis, or axial centerline 40. An inner tube 42 is disposed in, and is pinned to, packer mandrel 28 to help support plug 30.

Downhole tool 10, which may also be referred to as packer apparatus 10, includes the usage of a spacer ring 44 which is preferably secured to packer mandrel 28 by pins 46. Spacer ring 44 provides an abutment which serves to axially retain slip segments 48 which are positioned circumferentially about packer mandrel 28. Slip retaining bands 50 serve to radially retain slip segments 48 in an initial circumferential position about packer mandrel 28 as well as slip wedge 52. Bands 50 are made of a steel wire, a plastic material, or a composite material having the requisite characteristics of having sufficient strength to hold the slip segments 48 in place prior to actually setting the downhole tool 10 and to be easily drillable when the downhole tool 10 is to be removed from the wellbore 20. Preferably, bands 50 are inexpensive and easily installed about slip segments 48. Slip wedge 52 is initially positioned in a slidable relationship to, and partially underneath, slip segments 48 as shown in FIG. 1. Slip wedge 52 is shown pinned into place by pins 54. The preferred designs of slip segments 48 and co-acting slip wedges 52 are described in U.S. Pat. No. 5,540,279, which is incorporated herein by reference.

Located below slip wedge 52 is a packer element assembly 56, which includes at least one packer element, and as shown in FIG. 1 includes three expandable packer elements 58 positioned about packer mandrel 28. Packer element assembly 56 has unset and set positions 57 and 59 corresponding to the unset and set positions 11 and 13, respectively, of downhole tool 10. Packer element assembly 56 has upper end 60 and lower end 62.

Figure 3:
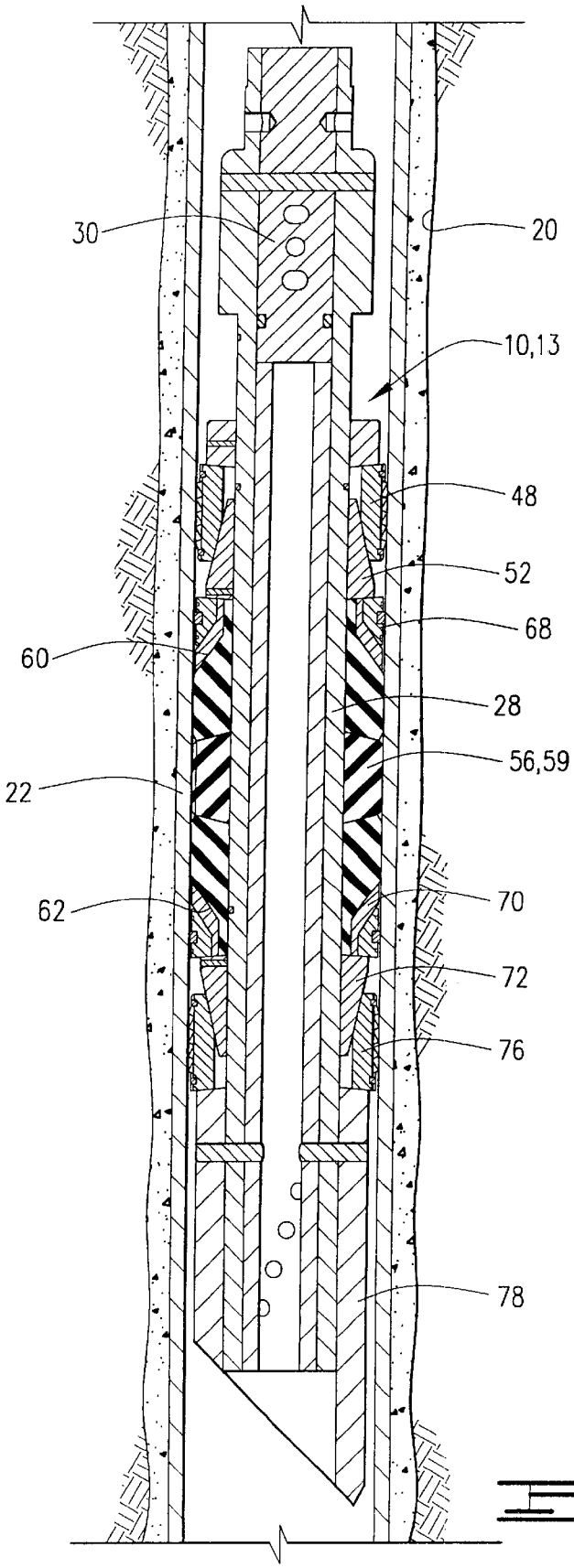
FIG. 3 is a cross-sectional side view of the packer apparatus of the present invention in a set position.
Figure 9:
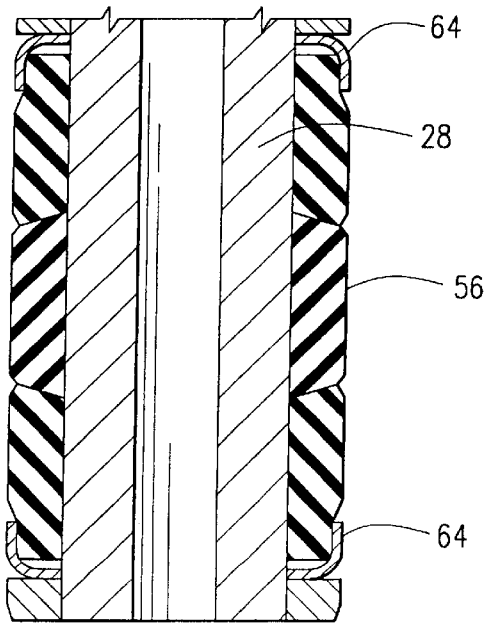
FIG. 9 PRIOR ART
FIG. 9 is a cross-sectional side view of a prior art packer element and a retainer shoe.

FIG. 9 shows a prior art arrangement wherein a single metallic shoe, such as shoe 64, is disposed about the upper and lower ends 60 and 62 of the packer element assembly 56. Referring to FIGS. 1–3, the present invention has retaining rings 66 disposed at the upper and lower ends 60 and 62 of packer element assembly 56 to axially retain the packer element assembly 56. Retaining rings, or retaining shoes 66 may be referred to as an upper retaining shoe, or upper retainer 68 and a lower retaining shoe, or lower retainer 70. A slip wedge 72 is disposed on packer mandrel 28 below lower retaining shoe 70 and is pinned with a pin 74. Located below slip wedge 72 are slip segments 76. Slip wedge 72 and slip segments 76 are like slip wedge 52 and slip segments 48. At the lowermost portion of downhole tool 10 is an angled portion, referred to as mule shoe 78, secured to packer mandrel 28 by pin 79. The lowermost portion of downhole tool 10 need not be mule shoe 78 but can be any type of section which will serve to terminate the structure of the downhole tool 10 or serve to connect the downhole tool 10 with other tools, a valve or tubing, etc. It will be appreciated by those in the art that pins 32, 46, 54, 74, and 79, if used at all, are preselected to have shear strengths that allow for the downhole tool 10 to be set and deployed and to withstand the forces expected to be encountered in the wellbore 20 during the operation of the downhole tool 10.

Referring now to FIGS. 2 and 4–8, the retaining shoes 66 of the present invention will be described. Upper and lower retaining shoes 68 and 70 are essentially identical. Therefore, the same designating numerals will be used to further identify features on each of retaining shoes 68 and 70, which are referred to collectively herein as retaining shoes 66. Retaining shoes 66 comprise an inner shoe, or inner retainer 80 and an outer shoe, or outer retainer 82. Inner and outer shoes 80 and 82 may also be referred to as first and second shoes or retainers 80 and 82. Outer shoe 82 is preferably made of a phenolic material available from General Plastics & Rubber Company, Inc., 5727 Ledbetter, Houston, Tex. 77087-4095, which includes a direction-specific laminate material referred to as GP-B35F6E21K. Alternatively, structural phenolics available from commercial suppliers may be used. Inner shoes 80 are preferably made of a composite material available from General Plastics & Rubber Company, Inc., 5727 Ledbetter, Houston, Tex. 77087-4095. A particularly suitable material for at least a portion of the inner shoe 80 includes a direction specific composite material referred to as GP-L45425E7K available from General Plastics & Rubber Company, Inc. Alternatively, structural phenolics available from commercial suppliers may be used.

Referring now to FIGS. 2, 4, 5, and 8, inner shoe 80 has a body 88 and a fin, or wing 90 extending radially outwardly therefrom. Inner shoe 80 has an inner surface 92 and an outer surface 94. As shown in FIG. 2, upper and lower ends 60 and 62 of packer element assembly 56 reside directly against upper and lower retainers 68 and 70 and preferably directly against wing 90 of inner shoe 80 at both the upper and lower ends 60 and 62 thereof. Inner shoe 80 is preferably comprised of a plurality of inner retainer segments, or inner shoe segments 96 to form inner shoe 80 that encircles packer mandrel 28. Inner surface 92 of inner shoe 80 is shaped to accommodate the upper and lower ends 60 and 62 of the packer element assembly 56 and thus is preferably sloped as well as arcuate to provide a generally truncated conical surface which transitions from having a greater radius proximate to an outer end, or outer face 98 of fin 90 to a smaller radius at an internal diameter 100 which is defined by body 88. Inner shoe 80 also has an inner end, or inner face 99. Inner surface 92 also defines a cylindrical surface on body 88 that engages packer mandrel 28 in an initial or running position of the downhole tool 10. Each inner shoe segment 96 has ends 102 and 104 which are flat and convergent with respect to a center reference point which, if the shoe segments 96 are installed about packer mandrel 28, will correspond to the longitudinal central axis 40 of the packer mandrel 28 as depicted in FIG. 1. Ends 102 and 104 need not be flat and can be of other topology.

Figure 4:
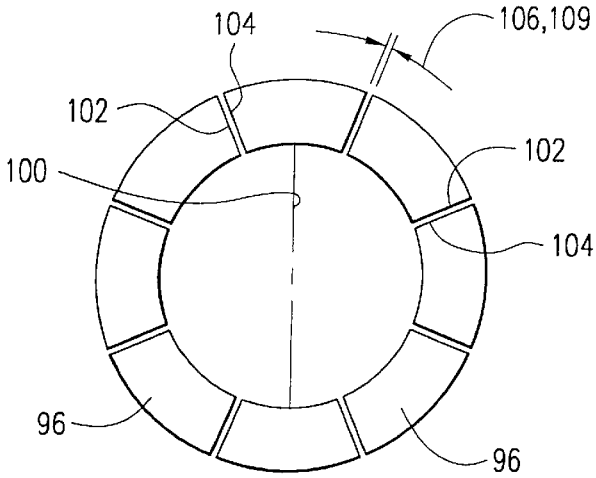
FIG. 4 is a top view of an inner shoe of the retaining shoe of the present invention.
Figure 5:
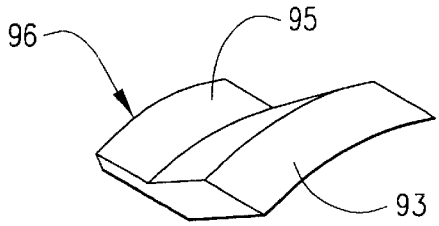
FIG. 5 is a perspective view of a single inner shoe segment.

Each inner shoe segment 96 has a fin portion 93 and a body portion 95. Fin portions 93 and body portions 95 comprise fin 90 and body 88, respectively, of inner shoe 80. FIG. 4 illustrates inner shoe 80 being made of a total of eight inner shoe segments 96 to provide a 360° annulus encircling structure to provide a maximum amount of end support for packer elements 58 to be retained in the axial direction. A lesser or greater amount of inner shoe segments 96 can be used depending on the nominal diameters of the packer mandrel 28, the packer elements 58, and the wellbore 20 or casing 22 in which the downhole tool 10 is to be deployed. Inner diameter 100 generally approaches the inner diameter of the packer element assembly 56. As is apparent from the drawings, outer surface 94 faces outwardly away from the downhole tool 10. The slope of inner surface 92 on fin 90 is preferably approximately 45° as shown in FIG. 2. However, the exact slope will be determined by the exterior configuration of the ends of the packer elements 58 that are to be positioned and eventually placed in contact with retaining shoe 66 and inner surface 92 on fin 90. Inner face 99 of inner shoe 80 is slightly sloped, approximately 5° if desired, but it is also best determined by the surface of the downhole tool 10 which it eventually abuts against when downhole apparatus 10 is centered in the wellbore 20.

A gap 106 is defined by adjacent ends 104 and 102 of inner shoe segments 96 before or after downhole tool 10 is set in the well 15. Gap 106 has a width 109 which can be essentially zero when the inner shoe segments 96 are initially installed about packer mandrel 28, and before the downhole tool 10 is moved from the unset position 11 to the set position 13. However, a small gap, for example a gap of 0.06" may be provided for on initial installation. The width 109 of gap 106, as will be described in more detail herein below, will increase from that which exists on initial installation as the downhole tool 10 is set.

Figure 6:
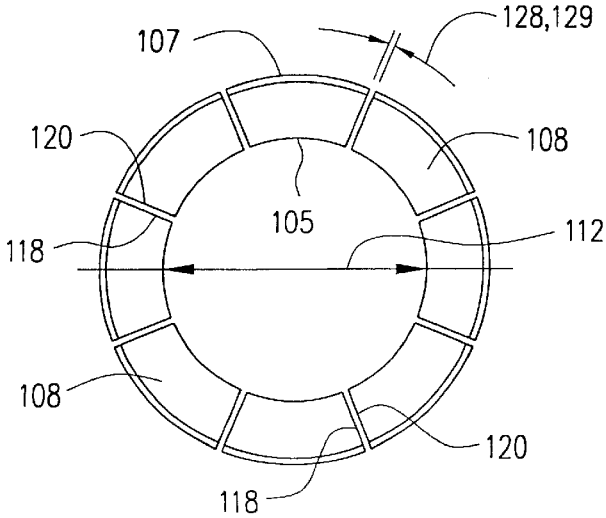
FIG. 6 is a top view of an outer shoe of the retaining shoe of the present invention.
Figure 7:
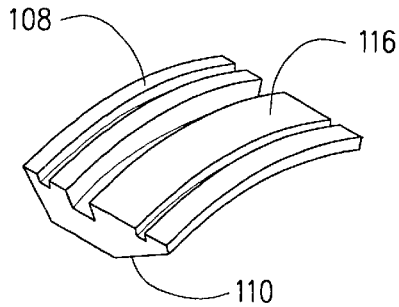
FIG. 7 is a perspective view of a single outer shoe segment of the present invention.

Referring now to FIG. 6, outer shoe 82 has an inner surface 105 and an outer surface 107. Outer shoe 82 preferably has a plurality of individual outer retainer segments, or outer shoe segments 108 to form outer shoe 82 which encircles inner shoe 80 and thus encircles packer mandrel 28. In a preferred embodiment, each inner shoe segment 96 is affixed to an outer shoe segment 108 by gluing or other means known in the art. Outer shoe segments 108 have an inner surface 110 and an outer surface 116. Inner surface 105 of outer shoe 82 defines an inner diameter 112 and thus defines a generally cylindrical surface 114 adapted to engage outer surface 94 of body 88 on inner shoe 80. Inner surface 105 likewise defines a truncated conical surface 115 to accommodate the outer end 98 of fin 90 and thus transitions from a greater radius proximate external, or outer surface 107 to the inner diameter 112. Ends 118 and 120 of outer shoe segments 108 are flat and convergent with respect to a center reference point, which if the outer shoe segments 108 are installed about the packer mandrel 28, corresponds to the longitudinal central axis 40 of packer mandrel 28. Ends 118 and 120 need not be flat and can be of other topology.

FIG. 6 illustrates outer shoe 82 being made of a total of eight outer shoe segments 108 to provide a 360° annulus, or encircling structure to provide the maximum amount of end support. A lesser or greater amount of outer shoe segments 108 can be used depending upon the nominal diameters of the packer mandrel 28, the packer elements 58 in the wellbore 20 or casing 22 in which the downhole tool 10 is to be deployed. A base 121 of outer shoe 82 is slightly sloped, approximately 5°, if desired, but is also best determined by the surface of the downhole tool 10 which the outer shoe 82 will eventually abut against, as for example in this case, the slip wedges 52 and 72. An O-ring 122 is received in a groove 124 in outer shoe 82. Retaining bands 126 are received in grooves 127 to initially hold the outer shoe segments 108 in place prior to actually setting the downhole tool 10. Gap 128 is a space between adjacent ends 118 and 120 of outer shoe segments 108 before or after the downhole tool 10 is set. Gap 128 has a width 129 that can be essentially zero when the outer shoe segments 108 are initially installed about downhole tool 10, but a small gap, such as 0.06" may exist after initial installation. The gap 128 will increase in width when the downhole apparatus 10 is set. Retaining bands 126 are preferably made of a non-metallic material, such as composite materials available from General Plastics & Rubber Company, Inc., 5727 Ledbetter, Houston, Tex. 77087-4095. However, retaining bands 126 may be alternatively made of a metallic material such as ANSI 1018 steel or any other material having sufficient strength to support and retain the retaining shoes 66 in position prior to actually setting the downhole tool 10. Furthermore, retaining bands 126 may have either elastic or non-elastic qualities depending on how much radial, and to some extent axial, movement of the outer shoe segments 108 can be tolerated prior to enduring the deployment of the associated downhole tool 10 into the wellbore 20. Referring now to FIGS. 1 and 2, downhole apparatus 10 is shown in its unset position 11 and thus the packer element assembly 56 is in its unset position 57. FIG. 3 shows the set position 13 of the downhole tool 10 and the corresponding set position 59 of the packer element assembly 56.

In unset position 57, retaining bands 126 serve to hold outer shoe segments 108 in place, and thus also hold inner shoe segments 96 in place. Prior to the downhole tool 10 being set, inner shoe 80 engages packer mandrel 28 about the upper and lower ends 60 and 62 of the packer element assembly 56. Inner shoe 80 of the lower retaining shoe 70 engages lower end 62 of packer element assembly 56 and inner shoe 80 of the upper retaining shoe 68 engages the upper end 60 of packer element assembly 56 in the unset positions 11 and 57 of downhole tool 10 and the packer element assembly 56, respectively. When the downhole tool 10 has reached the desired location in the wellbore 20, setting tools as commonly known in the art will move the downhole tool 10 and thus the packer element assembly 56 to their set positions 13 and 59, respectively, as shown in FIG. 3.

Figure 8:
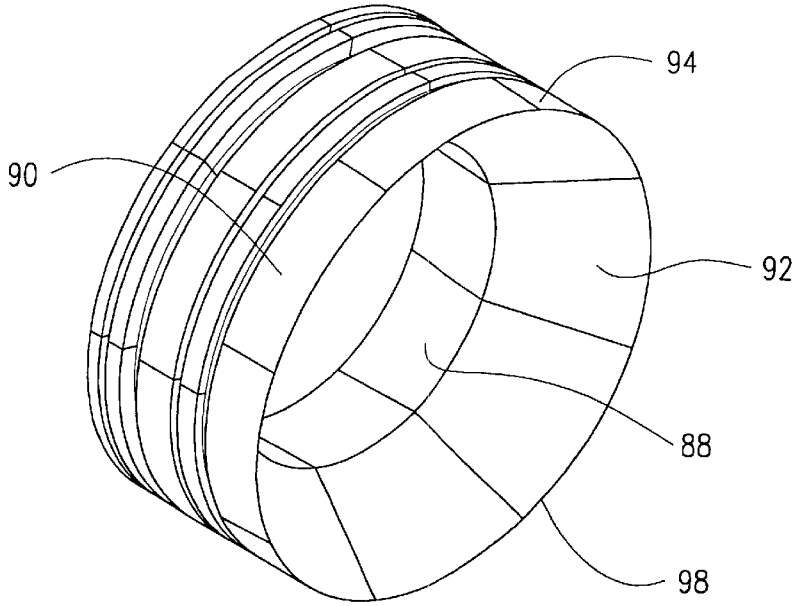
FIG. 8 is a perspective view of the retaining shoe of the present invention.

As shown in the perspective view of FIG. 8, inner shoe segments 96 are positioned so that gaps 106 which, as described before, may be zero when initially installed but may also be slightly greater than zero, will be located between the ends 118 and 120 of outer shoe segments 108. Likewise, gaps 128 between ends 118 and 120 of the outer shoe segments 108 will be positioned between the ends 102 and 104 of inner shoe segments 96. Gaps 106 are thus offset angularly from gaps 128. Gaps 128 are thus covered by inner shoe segments 96, and gaps 106 are covered by outer shoe segments 108. When the downhole tool 10 is moved to its set position 13, retaining bands 126 will break and retaining shoes 66, namely both of retaining shoes 68 and 70, will move radially outwardly to engage inner surface 24 of casing 22. The radial movement will cause width 109 and width 129 of gaps 106 and 128, respectively, to increase. However, gaps 106 and 128 will still be angularly offset, and thus gaps 128 will remain covered by inner shoe segments 96 of inner shoe 80 while gaps 106 will remain covered by outer shoe segments 108 of outer shoe 82. O-ring 122 will exert a force radially inwardly on outer shoe 82, and will transfer the force to inner shoe 80 as the downhole tool 10 is being moved to its set position 13. The gluing or affixing of each of the inner shoe segments 96 to an outer shoe segment 108, and the inward force applied by the O-ring 122, along with the friction between inner shoe 80 and outer shoe 82, provide for a generally equal separation between inner shoe segments 96 and between outer shoe segments 108, as retaining shoe 66 expands radially outwardly. In other words, the width 109 of each of gaps 106 and the width 129 of each of gaps 128, will be essentially uniform, or will vary only slightly as the retaining shoe 66 moves radially outwardly to its expanded position.

When the downhole tool 10 is moved to its set position 13, outer surface 107 of outer shoe 82 will engage inner surface 24 of casing 22 as will outer end 98 of inner shoe 80. The extrusion of packer elements 58 is essentially eliminated, since any material extruded through gaps 106 will engage outer shoe segments 108 of outer shoe 82 which will prevent further extrusion. Extrusion is likewise limited by slip wedges 52 and 72. Retaining shoes 66 are thus expandable retaining shoes and will prevent or at least limit the extrusion of the packer elements 58. Inner and outer retainers 80 and 82 may also be referred to as expandable retainers. The arrangement is particularly useful in high pressure, high temperature wells, since there is no extrusion path available. It should be understood, however, that the disclosed retaining shoes 66 may be used in connection with packer-type tools of lesser or greater diameters, differential pressure ratings, and operating temperature ratings than those set forth herein.

Figure 10:
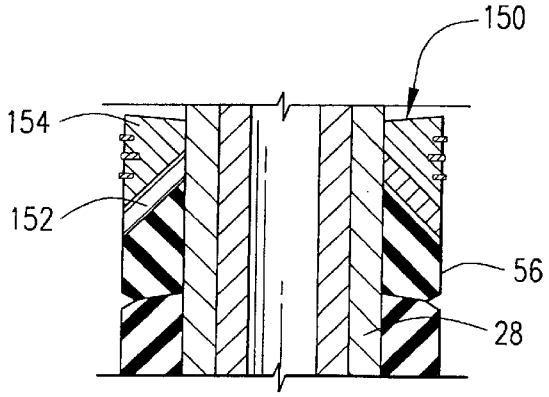
FIG. 10 is a cross-section of an alternative embodiment of a retaining shoe of the present invention.

Although the inner shoe 80 in the embodiment described herein has a fin 90 and a body 88, the body 88 may be eliminated so that the inner surface 105 of the outer shoe 82 will extend so that it engages the outer surface 36 of the packer mandrel 28 in the unset position 11. In other words, the inner shoe 80 may comprise only the wing 90 so that it will engage the upper and lower ends 60 and 62 of the packer element assembly 56. Such an arrangement is shown in FIG. 10 in cross-section. As shown in FIG. 10, a retaining shoe 150 may be disposed about packer mandrel 28 and may include a first, or inner shoe 152 and a second, or outer shoe 154. Inner shoe 152 is generally identical in all aspects to inner shoe 80, except that it does not include a body 88. Outer shoe 154 likewise is similar to outer shoe 82. However, as is apparent from the drawing, outer shoe 154 will engage packer mandrel 28 in the unset position 11 of the downhole tool 10. Inner shoe 152 and outer shoe 154, like inner and outer shoes 80 and 82, are comprised of a plurality of segments that will have gaps therebetween when retaining shoe 150 expands radially outwardly to engage the casing 22 in the well 15. The segments are positioned so that the gaps between segments in inner shoe 152 are covered by the segments that make up outer shoe 154. Likewise, the gaps between segments in outer shoe 154 will be covered by the segments that comprise inner shoe 152. Thus, retaining shoe 150 will prevent, or at least limit, the extrusion of the packer element assembly 56 when it is in the set position 13.

Although the disclosed invention has been shown and described in detail with respect to a preferred embodiment, it will be understood by those skilled in the art that various changes in the form and detailed area may be made without departing from the spirit and scope of this invention as claimed. Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. A downhole apparatus for use in a wellbore, the apparatus comprising:

a packer mandrel;

a packer element assembly disposed about said packer mandrel, wherein the packer element assembly has an upper end and a lower end, the packer element assembly is movable from an unset position to a set position, and the packer element assembly engages the wellbore in the set position; and a retaining shoe for axially retaining the packer element assembly, the retaining shoe comprising:

a first shoe, the first shoe comprising a plurality of first shoe segments disposed about the packer mandrel, wherein the plurality of first shoe segments engages one of the upper and lower ends of the packer element assembly, and adjacent ones of the first shoe segments having gaps therebetween; and a second shoe, the second shoe comprising a plurality of second shoe segments disposed about and engaging the plurality of first shoe segments, wherein adjacent ones of the plurality of second shoe segments have gaps therebetween, each of the second shoe segments being affixed to a first shoe segment;

wherein the retaining shoe has an initial position and a radially expanded second position, the retaining shoe moves from the initial position to the second position when the packer element assembly moves from the unset position to the set position, a width of the gaps between the first shoe segments and a width of the gaps between the second shoe segments increase when the retaining shoe moves from the initial position to the second position, the first shoe segments cover the gaps between the second shoe segments, and the second shoe segments cover the gaps between the first shoe segments in the initial position and the second position.

2. The apparatus of claim 1, wherein the first shoe segments engage the packer mandrel in the initial position and engage the wellbore in the second position, the second shoe segments and the wellbore define a space therebetween in the initial position, and the second segments engage the wellbore in the second position.

3. The apparatus of claim 1, wherein an inner surface of the second shoe segments engages an outer surface of the first shoe segments, and the second shoe segments engage the wellbore in the second position and do not engage the packer mandrel in the initial position or the second position.

4. The apparatus of claim 1, wherein the first shoe segments have an arcuate inner surface adapted to engage one of the upper and lower ends of the packer element assembly.

5. The apparatus of claim 1, wherein each said first shoe segment comprises:

a body portion, wherein the body portion engages the packer mandrel when the retaining shoe is in the initial position; and a fin portion extending radially outwardly from the body portion for engaging one of the upper or lower ends of the packer element assembly, wherein the body portions of the first shoe segments define a body of the first shoe, and the fin portions of the first shoe segments define a fin of the first shoe.

6. The apparatus of claim 5, wherein the retaining shoe is an upper retaining shoe and the apparatus further comprises a lower retaining shoe, wherein the upper retaining shoe is disposed at the upper end of the packer element assembly and the lower retaining shoe is disposed at the lower end of the packer element assembly, the fin on the upper retaining shoe engages the upper end of the packer element assembly, and the fin on the lower retaining shoe engages the lower end of the packer element assembly.

7. The apparatus of claim 5, wherein the body generally defines a cylindrical shape when disposed about the packer mandrel, and the fin extends radially outwardly from the body.

8. The apparatus of claim 5, wherein an inner surface of the second shoe defines a generally truncated cone shape for engaging the fin of the first shoe.

9. The apparatus of claim 1, wherein each second shoe segment is affixed to a first shoe segment by gluing.

10. A retaining shoe for limiting the extrusion of a packer element assembly disposed about a packer mandrel, wherein the packer element assembly is movable from an unset position to a set position in a wellbore, and the packer element assembly seals the wellbore when moved to the set position, the retaining shoe comprising:

a plurality of first shoe segments encircling the packer mandrel, wherein the first shoe segments define a sloped, arcuate inner surface for engaging an end of the packer element assembly, and adjacent ones of the first shoe segments have gaps therebetween;

a plurality of second shoe segments disposed about the first shoe segments, where the second shoe segments define a sloped, arcuate inner surface for engaging a sloped arcuate outer surface of the first shoe segments, and adjacent ones of the second shoe segments have gaps therebetween wherein each second shoe segment is affixed to a first shoe segment; and wherein a width of the gaps between the first shoe segments and a width of the gaps between the second shoe segments increase when the packer element assembly moves from the unset position to the set position, and the first shoe segments cover the gaps between the second shoe segments and the second shoe segments cover the gaps between the first shoe segments.

11. The retaining shoe of claim 10, wherein the retaining shoe is movable from an initial position corresponding to the unset position of the packer element assembly, to an expanded position corresponding to the set position of the packer element assembly, the retaining shoe and the wellbore define a gap therebetween when the retaining shoe is in the initial position, and the retaining shoe engages the wellbore in the expanded position.

12. The retaining shoe of claim 11, wherein the first shoe segments engage the packer mandrel in the initial position and engage the wellbore in the expanded position, and the second shoe segments engage the wellbore in the expanded position.

13. The retaining shoe of claim 10, wherein each said first shoe segment comprises:

a body portion; and a fin portion connected to the body portion, the fin portion sloping outwardly from the body portion.

14. The retaining shoe of claim 13, wherein the fin portion engages the wellbore in the expanded position.

15. The retaining shoe of claim 14, wherein each second shoe segment has an inner surface and an outer surface, the inner surface is configured to engage an outer surface of the fin portion and the body portion of the first shoe segments, and the outer surface of each second shoe segment engages the wellbore in the expanded position.

16. The retaining shoe of claim 13, wherein the first shoe segments define a first shoe and the second segments define a second shoe, the body portions of the first shoe segments define a body of the first shoe, the fin portions of the first shoe segments define a fin of the first shoe, the body has a generally cylindrical shape, and the fin extends radially outwardly from the body for engaging an end of the packer element assembly.

17. The apparatus of claim 10, wherein each second shoe segment is affixed to a first shoe segment by gluing.

18. A downhole apparatus for use in a wellbore, the apparatus comprising:

a packer mandrel having an axial centerline;

a packer element assembly disposed about the packer mandrel, wherein the packer element assembly has an upper end and a lower end and is movable from an unset position wherein the packer element assembly and the wellbore define an annular gap therebetween, to a set position wherein the packer element assembly sealingly engages the wellbore;

an upper retaining shoe for axially retaining the packer element assembly, the upper retaining shoe comprising an upper inner retainer and an upper outer retainer, the upper inner retainer comprising:

a generally cylindrical upper body disposed about the packer mandrel; and an upper fin connected to and extending radially outwardly from the upper body, wherein the upper fin engages the upper end of the packer element assembly, the upper outer retainer is disposed about the upper inner retainer, and the upper inner and upper outer retainers are movable from an initial position corresponding to the unset position of the packer element assembly wherein an annular gap exists between the upper retaining shoe and the wellbore, to an expanded position corresponding to the set position of the packer element assembly wherein the upper retaining shoe engages the wellbore wherein the upper inner retainer is comprised of a plurality of upper inner retainer segments, and wherein the upper outer retainer comprises a plurality of upper outer retainer segments, each upper inner retainer segment being affixed to an upper outer retainer segment; and a lower retaining shoe, the lower retaining shoe comprising a lower inner retainer and a lower outer retainer, the lower inner retainer comprising:

a generally cylindrical lower body disposed about the packer mandrel; and a lower fin connected to and extending radially outwardly from the lower body, wherein the lower fin engages the lower end of the packer element assembly, the lower outer retainer is disposed about the lower inner retainer, and the lower inner and lower outer retainers are movable from the initial position corresponding to the unset position of the packer element assembly, to the expanded position corresponding to the set position of the packer element assembly.

19. The apparatus of claim 18, wherein adjacent ones of the upper inner retainer segments have gaps therebetween, and a width of the gaps between the adjacent upper inner retainer segments increases when the upper retaining shoe moves from the initial position to the expanded position; and adjacent ones of the upper outer retainer segments have gaps therebetween, a width of the gaps between the adjacent upper outer retainer segments increases when the upper retaining shoe moves from the initial position to the expanded position, and the upper outer retainer segments cover the gaps between the upper inner retainer segments and the upper inner retainer segments cover the gaps between the upper outer retainer segments.

20. The apparatus of claim 19, wherein the lower inner retainer further comprises:

a plurality of lower inner retainer segments, wherein adjacent ones of the lower inner retainer segments have gaps therebetween, and a width of the gaps between the adjacent lower inner retainer segments increases when the lower retaining shoe moves from the initial position to the expanded position; and wherein the lower outer retainer comprises:

a plurality of lower outer retainer segments, each lower outer retainer segment being affixed to a lower inner retainer segment wherein adjacent ones of the lower outer retainer segments have a gap therebetween, a width of the gaps between the adjacent lower outer retainer segments increases when the lower retaining shoe moves from the initial position to the expanded position, and the lower outer retainer segments cover the gaps between the lower inner retainer segments and the lower inner retainer segments cover the gaps between the lower outer retainer segments.

21. The apparatus of claim 20, wherein each upper inner retainer segment comprises:

a generally vertical upper inner retainer segment body portion having arcuate inner and outer surfaces; and an upper inner retainer segment fin portion sloping outwardly from the upper inner retainer segment body portion, wherein the upper inner retainer segment fin portion has arcuate inner and outer surfaces; and wherein each lower inner retainer segment comprises:

a generally vertical lower inner retainer segment body portion having arcuate inner and outer surfaces; and a lower inner retainer segment fin portion sloping outwardly from the lower inner retainer segment body portion, wherein the lower inner retainer segment fin portion has arcuate inner and outer surfaces.

22. The apparatus of claim 21 wherein the upper outer retainer segments are configured to engage the upper inner retainer segment body portions and the upper inner retainer segment fin portions, the upper inner retainer segments will engage the wellbore in the expanded position, the lower outer retainer segments are configured to engage the lower inner retainer segment body portions and the lower inner retainer segment fin portions, and the lower outer retainer segments will engage the wellbore in the expanded position.

23. A retaining shoe for limiting the extrusion of a packer element assembly disposed about a packer mandrel, wherein the packer element assembly is movable from an unset position to a set position in a wellbore, and the packer element assembly seals the wellbore when moved to the set position, the retaining shoe comprising:

an outer shoe comprising a plurality of outer shoe segments; and an inner shoe comprising a plurality of inner shoe segments;

wherein each of the inner shoe segments is affixed to an outer shoe segment so that each inner shoe segment will move together with an outer shoe segment, and where the outer shoe segments engage the wellbore when the packer element assembly moves from the unset position to the set position, adjacent ones of the outer shoe segments have a gap therebetween, and adjacent ones of the inner shoe segments have a gap therebetween when the packer element assembly is in the set position.

24. The retaining shoe of claim 23, wherein the outer shoe segments span the gaps between the inner shoe segments, and the inner shoe segments span the gaps between the outer shoe segments.

25. The retaining shoe of claim 23, wherein each inner shoe segment is affixed to an outer shoe segment by gluing.

* * * * *